US010328606B2

(12) United States Patent
Uchida

(10) Patent No.: US 10,328,606 B2
(45) Date of Patent: Jun. 25, 2019

(54) CUTTING APPARATUS

(71) Applicant: DISCO CORPORATION, Tokyo (JP)

(72) Inventor: Fumio Uchida, Tokyo (JP)

(73) Assignee: Disco Corporation, Tokyo (JP)

( * ) Notice: Subject to any disclaimer, the term of this patent is extended or adjusted under 35 U.S.C. 154(b) by 182 days.

(21) Appl. No.: 15/647,938

(22) Filed: Jul. 12, 2017

(65) Prior Publication Data

US 2018/0015638 A1 Jan. 18, 2018

(30) Foreign Application Priority Data

Jul. 13, 2016 (JP) ..... 2016-138338

(51) Int. Cl.

| | |
|---|---|
| ***B28D 5/00*** | (2006.01) |
| ***B28D 5/02*** | (2006.01) |
| ***B28D 7/00*** | (2006.01) |
| ***B24B 49/16*** | (2006.01) |
| ***B24B 55/02*** | (2006.01) |
| ***B24B 49/00*** | (2012.01) |
| ***B28D 1/04*** | (2006.01) |
| ***B28D 7/02*** | (2006.01) |
| *B26D 1/54* | (2006.01) |
| *B28D 1/24* | (2006.01) |

(52) U.S. Cl.

CPC ..... *B28D 5/0076* (2013.01); *B24B 49/006* (2013.01); *B24B 49/16* (2013.01); *B24B 55/02* (2013.01); *B28D 1/044* (2013.01); *B28D 1/046* (2013.01); *B28D 5/0064* (2013.01); *B28D 5/022* (2013.01); *B28D 7/005* (2013.01); *B28D 7/02* (2013.01); *B26D 1/54* (2013.01); *B28D 1/24* (2013.01)

(58) Field of Classification Search

CPC ..... B24B 49/006; B24B 49/16; B24B 55/02; B28D 5/0064; B28D 5/0076; B28D 5/022; B28D 7/005

See application file for complete search history.

(56) References Cited

U.S. PATENT DOCUMENTS

| | | | | |
|---|---|---|---|---|
| 6,371,100 | B2 * | 4/2002 | Sekiya | B28D 5/0064 125/13.01 |
| 9,969,104 | B2 * | 5/2018 | Sever | B28D 7/02 |
| 2016/0311127 | A1 * | 10/2016 | Itatani | B26D 7/088 |
| 2016/0346956 | A1 * | 12/2016 | Takekawa | B28D 7/005 |

FOREIGN PATENT DOCUMENTS

| | | |
|---|---|---|
| JP | 2006-187849 | 7/2006 |

* cited by examiner

*Primary Examiner* — Timothy V Eley
(74) *Attorney, Agent, or Firm* — Greer Burns & Crain, Ltd.

(57) ABSTRACT

A controller of a cutting apparatus includes: a storage section configured to preliminarily store as a threshold an arbitrary value based on a load current value of a motor detected when a cutting blade is rotated at a predetermined rotational speed while supplying a predetermined quantity of cutting water in a state in which a cutting water supply nozzle is positioned in an appropriate position; and a judgment section configured to judge normality or abnormality according to the result of comparison between a load current value detected when the cutting blade is rotated at the predetermined rotational speed while supplying the predetermined quantity of cutting water and the threshold stored in the storage section.

2 Claims, 5 Drawing Sheets

FIG.3

| Data | Rotational speed (rpm) | Supply quantity (L/m) | Mark in graph |
|---|---|---|---|
| A | 45,000 | 1.5 | ▲ |
| B | 30,000 | 1.5 | ● |
| C | 45,000 | 1.0 | ✳ |
| D | 30,000 | 1.0 | ◆ |

CUTTING APPARATUS

BACKGROUND OF THE INVENTION

Field of the Invention

The present invention relates to a cutting apparatus for cutting a workpiece by a cutting blade while supplying cutting water.

Description of the Related Art

Such a workpiece as a semiconductor wafer and an optical device wafer is cut along streets (division lines) by a cutting apparatus. The cutting apparatus includes a chuck table that holds the workpiece, cutting means including a cutting blade that cuts the workpiece held by the chuck table, and a nozzle for supplying cutting water to the cutting blade during processing, the workpiece being cut and divided by the cutting blade which is rotated. In the cutting apparatus, the cutting water is supplied to the cutting blade rotated at high speed, whereby the process heat can be cooled, and swarf generated upon cutting can be washed away from the workpiece.

However, if the position of the nozzle is set into an erroneous position and cutting water is not supplied to an appropriate position of the cutting blade, the process heat would not be cooled sufficiently. Therefore, abnormal wear or burning of the cutting blade would be generated, and the processing quality would be degraded, possibly leading to breakage of the cutting blade or the workpiece. In view of this problem, there has been proposed a cutting apparatus in which the position of a nozzle can be adjusted in relation to a cutting blade (see, for example, Japanese Patent Laid-open No. 2006-187849).

SUMMARY OF THE INVENTION

Such a cutting apparatus, however, has a problem that at the time of replacing the cutting blade or in a similar situation, the operator may unintentionally touch the nozzle, causing a positional deviation of the nozzle. In this case, the positional deviation of the nozzle may be too small to find by visual observation, and the cutting may be continued in a condition of insufficient cooling, which may possibly lead to worsening of processing quality or to breakage of the cutting blade or the workpiece.

Accordingly, it is an object of the present invention to provide a cutting apparatus in which whether or not a cutting water supply nozzle is positioned appropriately can be checked before the start of processing.

In accordance with an aspect of the present invention, there is provided a cutting apparatus including: cutting means which includes a spindle supported in a rotatable manner, a motor for rotationally driving the spindle, a cutting blade mounted to a tip portion of the spindle, and a cutting water supply nozzle for supplying cutting water to the cutting blade; load current value detecting means for detecting a load current value of the motor; and control means for controlling the cutting means and the load current value detecting means. The control means includes: a storage section configured to preliminarily store as a threshold an arbitrary value based on a load current value detected by the load current value detecting means when the cutting blade is rotated at a predetermined rotational speed while supplying a predetermined quantity of cutting water in a state in which the cutting water supply nozzle is positioned in an appropriate position; and a judgment section configured to judge normality or abnormality according to a result of comparison between a load current value detected by the load current value detecting means when the cutting blade is rotated at the predetermined rotational speed while supplying the predetermined quantity of cutting water and the threshold stored in the storage section.

According to this configuration, prior to processing of a workpiece, an arbitrary load current value in a state in which the cutting water supply nozzle is positioned in an appropriate position is preliminarily stored as a threshold, as aforementioned. In the case where the load current value detected at the time of performing processing is deviated from the threshold by a predetermined range, it can be judged by the judgment section that the nozzle position is inappropriate. As a result, an abnormality in the position of the cutting water supply nozzle can be grasped prior to processing of the workpiece, and insufficient cooling or the like due to a positional deviation of the cutting water supply nozzle can be avoided, so that worsening of processing quality and breakage of the cutting blade or the workpiece can be prevented from occurring. Preferably, the thresholds are stored in the storage section on the basis of device data for processing of the workpiece.

According to the present invention, prior to the start of processing, a load current value of a motor is detected in a state in which cutting water is supplied to a cutting blade being rotated, and, based on the detection results, it is possible to check whether or not the cutting water supply nozzle is positioned appropriately.

The above and other objects, features and advantages of the present invention and the manner of realizing them will become more apparent, and the invention itself will best be understood from a study of the following description and appended claims with reference to the attached drawings showing a preferred embodiment of the invention.

BRIEF DESCRIPTION OF THE DRAWINGS

FIG. 3 shows a table in which an example of device data in the embodiment is shown;

DETAILED DESCRIPTION OF THE PREFERRED EMBODIMENT

Figure 1:
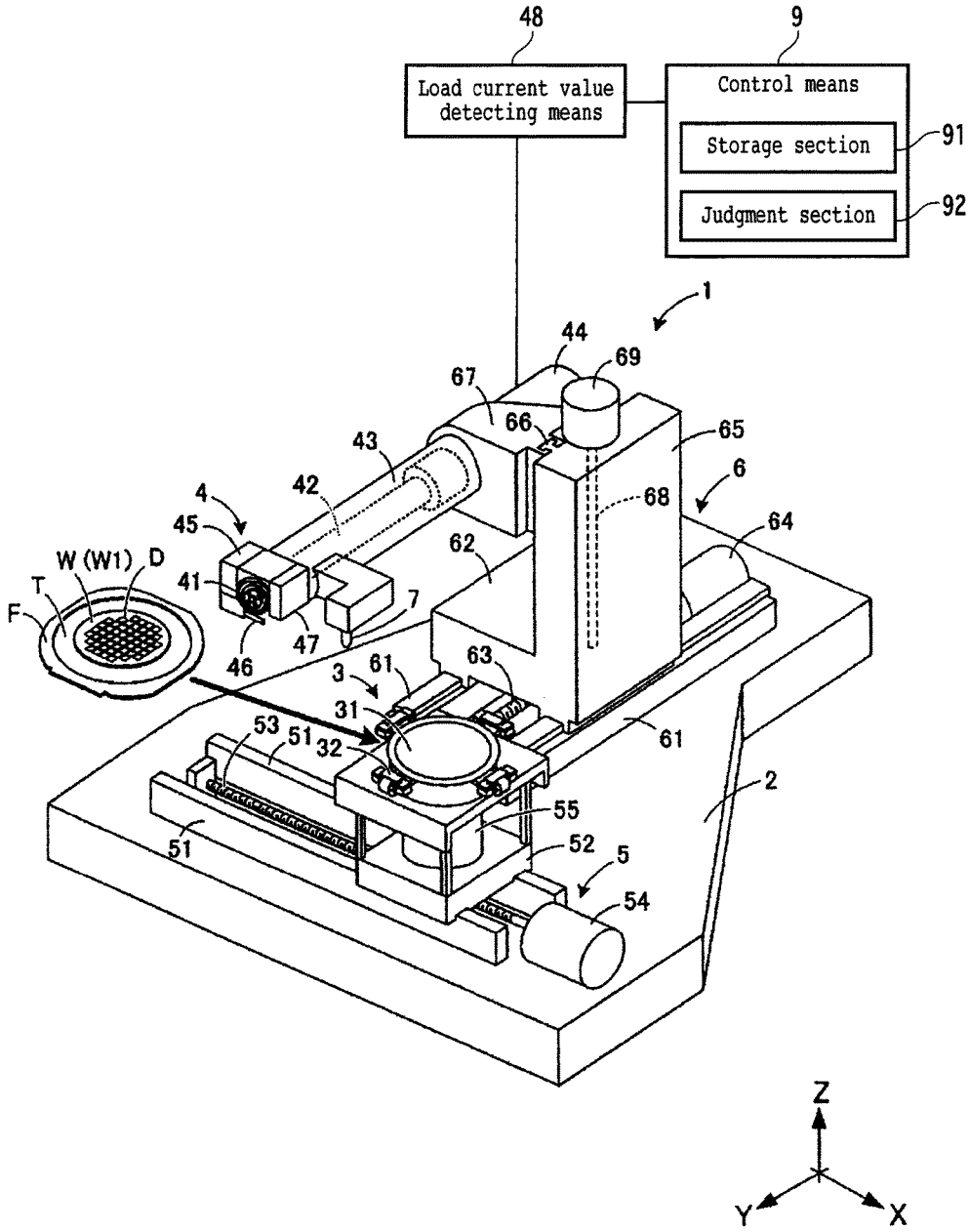
FIG. 1 is a perspective view of a cutting apparatus according to an embodiment of the present invention.

A cutting apparatus according to an embodiment of the present invention will be described below, referring to the attached drawings. FIG. 1 is a perspective view of the cutting apparatus according to the embodiment. Note that the cutting apparatus may have any configuration that is provided with a cutting water supply structure according to the embodiment, and is not limited to the configuration shown in FIG. 1. In addition, while some of members are omitted in FIG. 1 for convenience of explanation, the cutting apparatus is provided with those configurations which are ordinarily provided in a cutting apparatus.

As illustrated in FIG. 1, the cutting apparatus 1 is configured in such a manner that a cutting blade 41 of cutting means 4 is moved relative to a workpiece W held on a chuck table 3, whereby the workpiece W is divided into individual chips. Crossing division lines (streets) are provided on a front surface W1 of the workpiece W, and various devices D are formed in regions partitioned by the division lines. A dicing tape T is adhered to a back surface of the workpiece W, and an annular frame F is adhered to an outer periphery of the dicing tape T. The workpiece W is fed to the cutting apparatus 1 in the state of being supported on the annular frame F through the dicing tape T.

Note that the workpiece W may be a semiconductor wafer in which devices such as integrated circuits (ICs) and large-scale integrations (LSIs) are formed on a semiconductor substrate of silicon, gallium-arsenic or the like, or may be an optical device wafer in which optical devices such as light emitting diodes (LEDs) are formed on an inorganic material substrate based on a ceramic, a glass, sapphire or the like.

A chuck table moving mechanism 5 for moving the chuck table 3 in an X-axis direction is provided on a base 2 of the cutting apparatus 1. The chuck table moving mechanism 5 includes a pair of guide rails 51 disposed on the base 2 in parallel to the X-axis direction, and a motor-driven X-axis table 52 disposed on the pair of guide rails 51 in a slidable manner. The X-axis table 52 is formed with a nut section (not shown) on a back side thereof, and a ball screw 53 is in screw engagement with the nut section. When a driving motor 54 connected to one end portion of the ball screw 53 is driven to rotate, the chuck table 3 is thereby moved in the X-axis direction along the guide rails 51.

The chuck table 3 is rotatably provided at an upper portion of the X-axis table 52, through a A table 55. The chuck table 3 is formed on the upper side thereof with a holding surface 31 made of a porous ceramic material. The holding surface 31 is connected to a suction source (not shown) through a passage inside the chuck table 3, and the workpiece W is suction held by a negative pressure generated on the holding surface 31. In the periphery of the chuck table 3, four clamp sections 32 are provided through a pair of support arms. Each of the clamp sections 32 is driven by an air actuator (not shown), whereby the annular frame F in the surroundings of the workpiece W is fixed by clamping from four sides.

A cutting means moving mechanism 6 for moving the cutting means 4 in a Y-axis direction and a Z-axis direction over the chuck table 3 is provided on the base 2 of the cutting apparatus 1. The cutting means moving mechanism 6 includes a pair of guide rails 61 disposed on the base 2 in parallel to the Y-axis direction, and a motor-driven Y-axis table 62 disposed on the pair of guide rails 61 in a slidable manner. The Y-axis table 62 is formed to be rectangular in top view, and a side wall section 65 is set upright at one end portion in regard of the Y-axis direction of the Y-axis table 62.

In addition, the cutting means moving mechanism 6 includes a pair of guide rails 66 (only one of which is illustrated) disposed on a wall surface of the side wall section 65 in parallel to the Z-axis direction, and a Z-axis table 67 disposed on the pair of guide rails 66 in a slidable manner. The Y-axis table 62 and the Z-axis table 67 are formed with nut sections (not shown) on the back side thereof, and ball screws 63 and 68 are in screw engagement with the nut sections. When driving motors 64 and 69 connected to one end portions of the ball screws 63 and 68 are driven to rotate, the cutting means 4 is moved in the Y-axis direction and the Z-axis direction along the guide rails 61 and 66, respectively.

The Z-axis table 67 is provided with the cutting means 4 which has the cutting blade 41 mounted to the tip of the spindle 42. The spindle 42 is rotatably supported inside a spindle case 43 extending in the Y-axis direction from the Z-axis table 67, and is rotationally driven by a motor 44 inside the spindle case 43. As the cutting blade 41, there is selected, for example, an electroformed blade obtained by binding diamond abrasive grains into a circular shape by use of an electroforming bond. The periphery of the cutting blade 41 is covered with a box-shaped blade cover 45.

Figure 2:
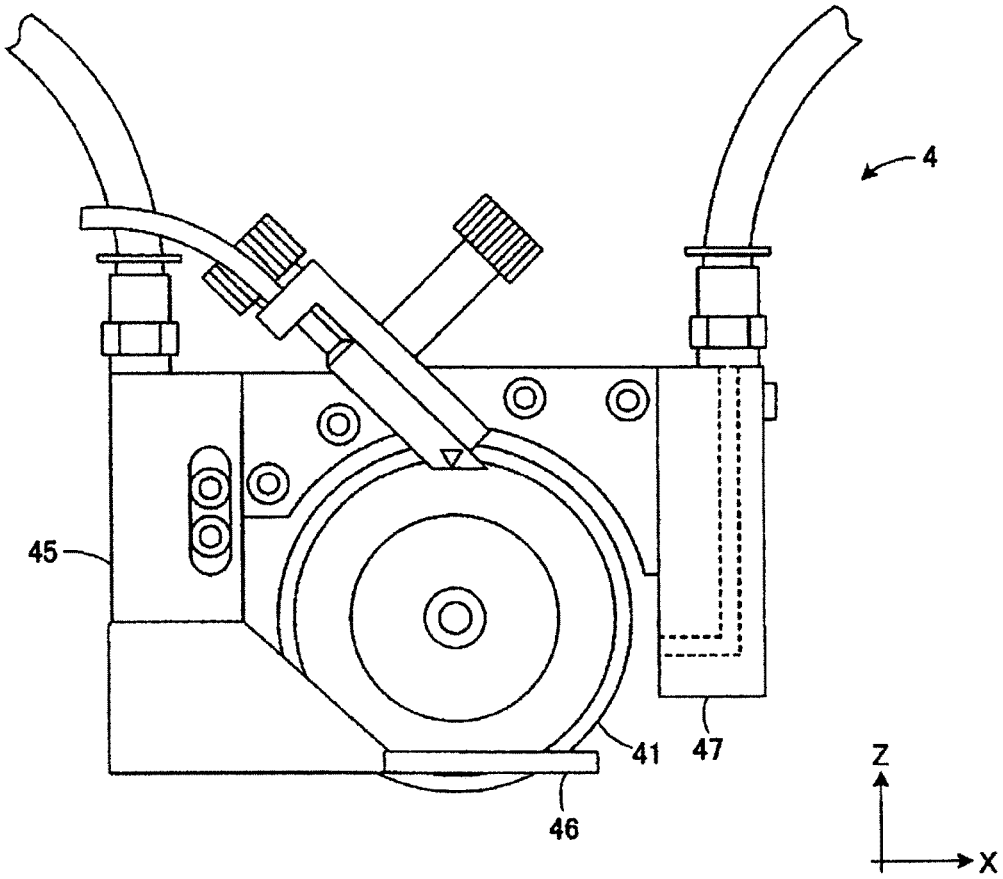
FIG. 2 is a front view of cutting means according to the embodiment.

FIG. 2 is a front view of the cutting means according to the embodiment. As shown in FIG. 2, the blade cover 45 of the cutting means 4 covers the periphery of the cutting blade 41 in a state in which part (a lower end portion) of the cutting blade 41 is projected. At a rear portion of the blade cover 45, there are provided a pair of cooling nozzles 46 (the cooing nozzle on one side is not shown) which extend in the X-axis direction and are located such that the cutting blade 41 is interposed therebetween. The cooling nozzles 46 constitute cutting water supply nozzles. The cooling nozzle 46 is formed with a slit in its part facing the cutting blade 41, and the cutting blade 41 and a processing point are cooled and washed with cutting water which is jetted from the slit. In addition, at a front portion of the blade cover 45, there is provided a shower nozzle 47 which constitutes a cutting water supply nozzle. The shower nozzle 47 jets the cutting water toward the cutting blade 41 from the front side, in such a manner that the cutting water is caught by the cutting blade 41, whereby the cutting blade 41 and the processing point are cooled.

In such a cutting apparatus 1, the cutting blade 41 is aligned with a division line (street) provided on the workpiece W on the radially outer side of the workpiece W, and the cutting blade 41 is lowered to a height at which cutting into the workpiece W is possible. The chuck table 3 is put into cutting feed in the X-axis direction relative to the cutting blade 41, whereby the workpiece W is cut along the division line. In this instance, the cutting water is jetted from the cooling nozzles 46 and the shower nozzle 47 toward the processing point of the cutting blade 41, so that process heat is removed, abnormal wear or burning of the cutting blade 41 is prevented from occurring, and quality of processing by the cutting is enhanced.

As shown in FIG. 1, imaging means 7 for alignment, by which the front surface W1 of the workpiece W held on the chuck table 3 is imaged, is provided at the spindle case 43, and alignment of the cutting blade 41 relative to the division line provided on the workpiece W is performed based on an image picked up by the imaging means 7. In addition, load current value detecting means 48 for detecting a load current value of the motor 44 is connected to the cutting means 4.

Besides, the cutting apparatus 1 is provided with control means 9 for general control of components of the apparatus, including the cutting means 4 and the load current value detecting means 48. The control means 9 includes a processor for performing various kinds of processing, a memory and the like. The memory includes one or a plurality of storage media, such as read only memory (ROM) and random access memory (RAM). The memory constitutes a storage section 91 for preliminarily storing as a threshold a load current value detected by the load current value detecting means 48 under the conditions which will be described later. In addition, the control means 9 has a judgment section 92, which compares the threshold stored in the storage section 91 with a load current value detected by the load current value detecting means 48, and judges that an abnormal condition exists when the detected load current value is found, as a result of the comparison, to be smaller than the threshold. Besides, when the detected load current value is found greater than the threshold, the judgment section 92 judges that a normal condition exists.

In the cutting apparatus 1, when the operator touches the cooling nozzle 46 or the shower nozzle 47 to cause a positional deviation, it may be difficult to check or grasp the positional deviation by visual observation. If cutting is continued in this condition, cutting water would not be supplied to an appropriate position and, as a result, sufficient cooling of the process heat would not be achieved. In view of this, in the embodiment, whether or not the position of the nozzles 46 or the nozzle 47 is appropriate can be judged by other method than the operator's visual observation. In this case, attention is paid to the fact that, when the cutting water is jetted to the cutting blade 41 in rotation before cutting, the load current value of the motor 44 for rotating the cutting blade 41 varies in the case where a positional deviation exists as compared to the case where the nozzles 46 or the nozzle 47 is in a reference position which will be described later. Then, when the load current value of the motor 44 as measured by the load current value detecting means 48 is varied by a predetermined amount, it is judged that there is abnormality in the positions of the nozzles 46 and 47. A method of judging the positions of the cooling nozzles 46 and the shower nozzle 47 will be described below.

In the cutting, while driving the motor 44 of the cutting means 4 and thereby rotating the cutting blade 41 at a predetermined rotational speed, a predetermined quantity of cutting water is supplied from the cooling nozzles 46 and the shower nozzle 47 to the cutting blade 41. In addition to the spindle rotational value and the quantity of the cutting water supplied in this instance, the kind (blade thickness, outside diameter, etc.) of the cutting blade 41 is combined with various conditions and numerical values, to prepare a group of data before the start of the cutting. The group of data constitutes device data for processing of the workpiece W. In the embodiment, data A to D set forth in Table in FIG. 3 are device data. Note that the device data A to D are mere examples, and other data may also be adopted.

Figure 4A:
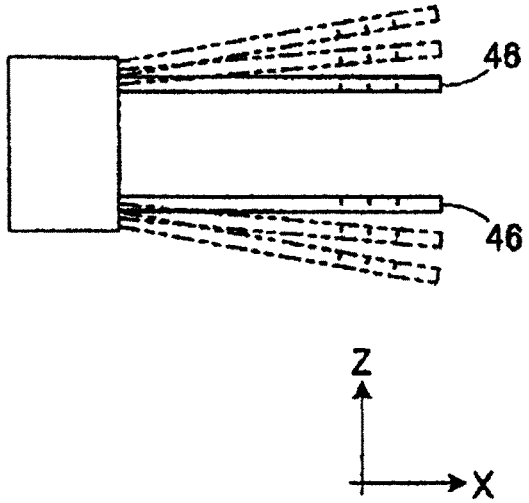
FIG. 4A is a schematic view of cooling nozzles according to the embodiment.
Figure 4B:
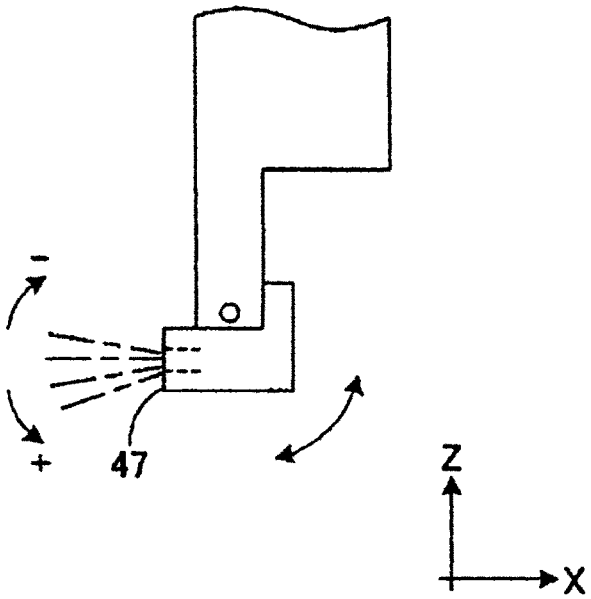
FIG. 4B is a schematic view of a shower nozzle.

Before the start of the cutting, positioning of the cooling nozzles 46 and the shower nozzle 47 to reference positions is conducted, in addition to the preparation of the device data. Though not particularly limited, in the embodiment, in regard of the cooling nozzles 46, the position such that the cooling nozzles 46 are parallel to the X-axis direction in top view, as depicted in FIG. 4A, is made to be a reference position. In regard of the shower nozzle 47, the position such that the extending direction of a jet port of the shower nozzle 47 is parallel to the X-axis direction in front view, as shown in FIG. 4B, is made to be a reference position.

Figure 5:
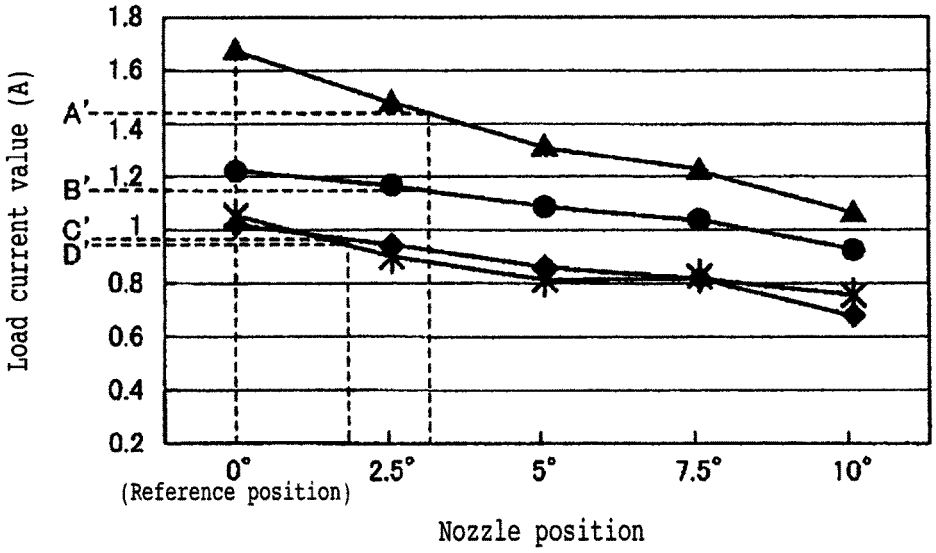
FIG. 5 is a graph showing the relationship between a nozzle position and a load current value when cutting water is supplied by the cooling nozzles.

Next, in the case of judging the position of the cooling nozzles 46, cutting water is supplied from the cooling nozzles 46 (note that supply of cutting water to the shower nozzle 47 is stopped) while driving the motor 44 in a before-cutting state in which the workpiece W is not yet cut, under the condition of each piece of data A to data D. Further, the load current value of the motor 44 is detected by the load current value detecting means 48, at the reference position of the cooling nozzles 46 (the position such that the cooling nozzles 46 are parallel (inclination: 0 degrees) to the X-axis direction) and a plurality of positions deviated from the reference position, under the condition of each piece of data A to data D. The position deviated from the reference position corresponds to a state in which the pair of cooling nozzles 46 are inclined in directions for spacing away from each other at a predetermined angle (for example, 2.5 degrees) each (see alternate long and two short dashes line parts in FIG. 4A), as compared to the reference position. When the deviation amount enables permissible cutting quality to be secured even though the position of the cooling nozzles 46 is deviated from the reference position, the cooling nozzles 46 are regarded as positioned in the appropriate position. Therefore, the appropriate position for the cooling nozzles 46 is not limited to a single position but includes a plurality of positions within such a range that permissible processing quality is secured. The detection results of the load current value are as shown in the graph in FIG. 5, and they are stored in the storage section 91 on the basis of the data A to D. In the graph of FIG. 5, the horizontal axis represents inclination relative to the reference position (positional deviation amount), and the vertical axis represents load current value detected by the load current value detecting means 48. From the graph of FIG. 5, it is seen that the load current value is lowered as the inclination of the cooling nozzles 46 increases and as the cooling nozzles 46 come away from the cutting blade 41.

Figure 6:
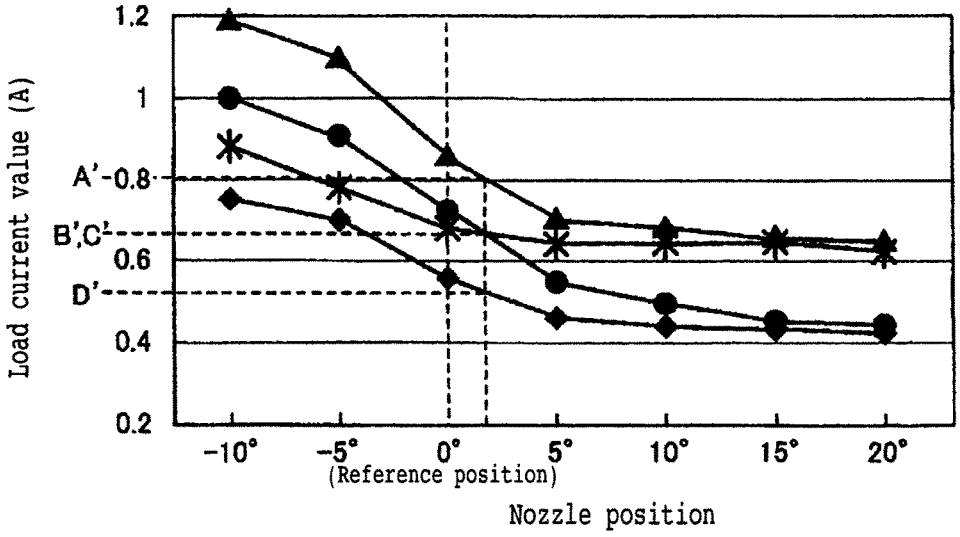
FIG. 6 is a graph showing the relationship between a nozzle position and a load current value when cutting water is supplied by the shower nozzle.

In the case of judging the position of the shower nozzle 47, cutting water is supplied from the shower nozzle 47 (note that supply of cutting water to the cooling nozzles 46 is stopped) while driving the motor 44 in a condition in which the workpiece W is not cut, under the condition of each piece of data A to data D. Further, the load current value of the motor 44 is detected by the load current value detecting means 48, at the reference position of the shower nozzle 47 (the position such that the extending direction of the jet port is parallel (inclination: 0 degrees) to the X-axis direction) and a plurality of positions deviated from the reference position, under the condition of each piece of data A to data D. The position deviated from the reference position corresponds to a state in which the shower nozzle 47 is inclined toward the rotating direction at a predetermined angle (for example, 5 degrees) each, as compared to the reference position. When the deviation amount enables permissible cutting quality to be secured even though the position of the shower nozzle 47 is deviated from the reference position, the shower nozzle 47 is regarded as positioned in the appropriate position. Therefore, the appropriate position for the shower nozzle 47 is not limited to a single position but includes a plurality of positions within such a range that permissible processing quality is secured. The detection results of the load current value are as shown in the graph in FIG. 6, and they are stored in the storage section 91 on the basis of the data A to D. In the graph of FIG. 6, the horizontal axis represents inclination relative to the reference position (positional deviation amount), and the vertical axis represents load current value detected by the load current value detecting means 48. From the graph of FIG. 6, it is seen that the load current value is enlarged as the inclination of the shower nozzle 47 becomes more upward, and the load current value is lowered as the inclination becomes more downward.

Based on the load current values detected as above, a threshold serving as a criterion for judging whether or not cutting can be carried out is obtained. The threshold is set at an arbitrary value based on the detected load current value, for example, the load current value at a position most deviated from the reference position under a condition where the processing quality after cutting is at a permissible level as aforementioned. The threshold is obtained on the basis of the device data. In FIG. 5, angles in the vicinity of nozzle position 2 degrees and 3 degrees are permissible angles, and load current values A', B', C' and D' corresponding thereto are made to be thresholds in regard of the respective pieces of data A to D. Besides, in FIG. 6, an angle in the vicinity of nozzle position 2 degrees is a permissible angle, and load current values A', B', C' and D' corresponding thereto are made to be thresholds in regard of the respective pieces of data A to D. The thresholds are stored in the storage section 91 on the basis of the data A to D (on a device data basis).

Before starting the cutting, the aforementioned thresholds are preliminarily determined and stored in the storage section 91. At the time of starting the cutting of a workpiece W or replacing the cutting blade 41, the positions of the cooling nozzles 46 and the shower nozzle 47 are checked. In this checking, the cutting blade 41 is rotated at a predetermined rotational speed while supplying cutting water from either the cooling nozzles 46 or the shower nozzle 47, under the conditions corresponding to the device data, before starting the processing by the cutting blade 41 replaced or the like. In this condition, the load current value of the motor 44 is detected by the load current value detecting means 48. After this detection is over, the supply of cutting water is switched over from either the cooling nozzles 46 or the shower nozzle 47 to the other, and detection of the load current value of the motor 44 is conducted similarly to the above.

Then, the detected load current value and the threshold corresponding to the device data stored in the storage section 91 are compared with each other by the judgment section 92. When the detected load current value is smaller than the threshold, it is judged by the judgment section 92 that the position of the relevant one of the nozzles 46 and 47 is abnormal. In other words, it can be grasped that the relevant one of the nozzles 46 and 47 has been deviated from the reference position to a non-permissible inappropriate position. In accordance with this judgment result, a control for inhibiting a cutting operation by the cutting means 4 is conducted by the control means 9, or, alternatively, an alarm for prompting the operator to adjust the positions of the nozzles 46 and 47 is issued from alarm means or the like (not shown).

As has been described above, in the cutting apparatus 1 according to the embodiment, the thresholds are preliminarily prepared and stored, and, each time a cutting blade 41 is mounted in position, the cutting blade 41 is rotated in a non-cutting condition while supplying cutting water as above-mentioned, whereby it is possible to judge whether or not the position of the nozzles 46 or the nozzle 47 is abnormal. This makes it possible to avoid a situation in which cutting is continued notwithstanding an unintentional deviation of the position of any of the nozzles 46 and the nozzle 47, and to ensure that cutting is conducted after the positions of the nozzles 46 and 47 are confirmed to be appropriate. As a result, cutting water can be supplied to an appropriate position, the process heat can be thereby sufficiently cooled, and a lowering in the quality of the workpiece W and breakage of the cutting blade 41 or the workpiece W can be prevented from occurring.

Note that the embodiment of the present invention is not limited to the above-described, and various changes, substitutions and modifications are possible within the scope of the gist of the technical thought of the present invention. Furthermore, if the technical thought of the present invention can be realized in a different manner, due to the progress of technology or by other derived technology, the present invention may be carried out by the different method. Accordingly, the claims cover all the embodiments which can fall within the scope of the technical thought of the present invention.

The threshold in the above-described embodiment may be changed, so long as it is possible to judge whether the nozzle positions are normal or abnormal. For example, the threshold may be an arbitrary value or range obtained by multiplying the load current value measured at an appropriate position of the nozzles 46 or the nozzle 47 by a predetermined coefficient or subtracting a predetermined value from the measured load current value (e.g., a value equivalent to 20% to 40% of the measured load current value). Besides, the threshold may be obtained, for example, by determining the load current value at a position deviated most from the reference position of the nozzles 46 or the nozzle 47, in a condition where the processing quality upon cutting is at a permissible level, and subtracting the thus determined load current value from a load current value at the reference position, to obtain the desired threshold. In this case, the difference (absolute value) between the detected load current value and the load current value at the reference position is obtained, and the difference is compared with the threshold corresponding to the device data, in the judgment section 92. According to the result of comparison, when the calculated difference is greater than the threshold, it is judged by the judgment section 92 that the position of the relevant one of the nozzles 46 and 47 is abnormal.

In addition, while the pair of cooling nozzles 46 and the shower nozzle 47 have been shown as an example in the above embodiment, this configuration is not restrictive. The cutting water supply nozzles may be configured in any way, so long as cutting water can be thereby supplied to the cutting blade 41.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A cutting apparatus comprising:

cutting means which includes a spindle supported in a rotatable manner, a motor for rotationally driving the spindle, a cutting blade mounted to a tip portion of the spindle, and a cutting water supply nozzle for supplying cutting water to the cutting blade;

load current value detecting means for detecting a load current value of the motor; and control means for controlling the cutting means and the load current value detecting means, wherein the control means includes:

a storage section configured to preliminarily store as a threshold an arbitrary value based on a load current value detected by the load current value detecting means when the cutting blade is rotated at a predetermined rotational speed while supplying a predetermined quantity of cutting water in a state in which the cutting water supply nozzle is positioned in an appropriate position; and a judgment section configured to judge normality or abnormality according to a result of comparison between a load current value detected by the load current value detecting means when the cutting blade is rotated at the predetermined rotational speed while supplying the predetermined quantity of cutting water and the threshold stored in the storage section.

2. The cutting apparatus according to claim 1, wherein the threshold is stored in the storage section on the basis of device data for processing of a workpiece.

* * * * *